US005743762A

United States Patent [19]

Takahashi

[11] Patent Number: 5,743,762

[45] Date of Patent: Apr. 28, 1998

[54] CONNECTOR

[75] Inventor: Toshiharu Takahashi, Shizuoka, Japan

[73] Assignee: Yazaki Corporation, Tokyo, Japan

[21] Appl. No.: 659,522

[22] Filed: Jun. 6, 1996

[30] Foreign Application Priority Data

Jun. 7, 1995 [JP] Japan ..... 7-140845

[51] Int. Cl.[6] ..... H01R 13/40

[52] U.S. Cl. ..... 439/595; 439/689

[58] Field of Search ..... 439/595, 381, 439/752, 598, 689

[56] References Cited

U.S. PATENT DOCUMENTS 5,151,052 9/1992 McCardell ..... 439/595 X
5,520,548 5/1996 Hotea et al. ..... 439/595 X
5,554,052 9/1996 Saijo et al. ..... 439/595 OR
5,607,327 3/1997 Tsuji et al. ..... 439/595 X

FOREIGN PATENT DOCUMENTS 63-28265 2/1988 Japan .

*Primary Examiner*—Neil Abrams
*Assistant Examiner*—Daniel Wittels
*Attorney, Agent, or Firm*—Morgan, Lewis and Bockius LLP

[57] ABSTRACT

A front end surface of a connector housing serves as a fitting abutment surface for abutment against a mating connector. A recessed portion is formed in the fitting abutment surface, and a front holder for detecting a half-fitted condition of a terminal and for effecting the double retaining of the terminals is attached to this recessed portion. Tapered portions, which respectively guide mating terminals when the two connectors are to be fitted together, are formed at the front holder. The front holder is fitted in the recessed portion in such a manner that a front surface of the front holder is disposed inwardly of the fitting abutment surface of the connector housing.

3 Claims, 4 Drawing Sheets

CONNECTOR

BACKGROUND OF THE INVENTION

1. Field of the Invention

This invention relates to a connector construction in which a front holder for detecting a half-fitted condition of a terminal and for effecting the double retaining of the terminals is attached to a fitting abutment surface of a housing.

2. Related Art

In one type of connector, a front holder for detecting a half-fitted condition of a terminal and for effecting the double retaining of the terminals is attached to a fitting abutment surface. One example of such connector, in which the front holder is attached, for example, to a male connector, will now be described with reference to FIG. 5. FIG. 5 is a cross-sectional view of the conventional connector in which the front holder is attached to the male connector.

Male terminals 5 project from a fitting abutment surface 3 of a female connector 1, and are surrounded by a peripheral wall 7. A packing 9 is provided on an inner peripheral surface of the peripheral wall 7, and is adapted to closely fit on an outer periphery of a front end portion of a male connector housing (described later), thereby sealing the fitted portion in an airtight manner.

Terminal receiving chambers 15 are formed in the housing 13 of a male connector 11, and a female terminal 17 is received in each of the terminal receiving chambers 15. The female terminal 17 is retained by an elastic retaining piece portion 19, projecting into the terminal receiving chamber 15, against withdrawal from the terminal receiving chamber 15. A retraction space 21 is formed at the back side of the elastic retaining piece portion 19, and is open to a front surface 23 of the housing 13. A peripheral wall 25 extends from a peripheral edge portion of the front surface 23. Therefore, the front surface 23 of the housing 13 forms a recessed portion 27 surrounded by the peripheral wall 25. The front holder 31, having insertion levers 29 projecting therefrom, is attached to the recessed portion 27. The front holder 31 is thus attached, with the insertion levers 29 inserted respectively in the retraction spaces 21, in such a manner that a front surface **31*a* of the front holder 31 lies flush with a front end surface 25*a* of the peripheral wall 25**.

With this construction, if the female terminal 17, inserted into the terminal receiving chamber 15 from the rear end of the housing 13, is in a half-fitted condition, the elastic retaining piece portion 19 is projected in the retraction space 21, thereby preventing the insertion of the insertion lever 29, so that the half-fitted condition of the female terminal 17 can be detected. In contrast, when the elastic retaining piece portions 19 are properly engaged, so that all of the insertion levers 29 are inserted respectively in the retraction spaces 21, the flexing of each elastic retaining piece portion 19 into the retraction space 21 is prevented, thereby retaining the female terminal 17 in a double manner.

Terminal insertion ports 33 are formed in the front holder 31, and communicate respectively with terminal insertion ports 35 formed in the housing 13. Tapered portions 37 are formed in the front surface **31*a* of the front holder 31, and communicate respectively with the terminal insertion ports 33, the tapered portion 37 serving as a guide surface for guiding the male terminal 5 when fitting the connectors together. In order that the front holder 31 can be easily attached to the housing 13, the front holder 31 is fitted in the housing 13** with a predetermined clearance provided therebetween.

In the connector with the front holder 31 of the above construction, the tapered portions 37 for respectively guiding the male terminals 5 are formed in the front holder 31, and the front holder 31 is attached to the housing 13 with the predetermined clearance provided therebetween. Therefore, for example, when the male terminal 5 strongly strikes against the tapered portion 37 as shown in FIG. 6, the front holder 31 is displaced (or tilted) in an amount corresponding to the clearance, so that the opposite end portion remote from the strongly-engaged male terminal 5 is projected from the front end surface of the housing 13, that is, the front end surface **25*a* of the peripheral wall 25, as shown in FIG. 7. If the mating connector is fitted on the male connector in this condition, the projected portion 39 engages the fitting abutment surface 3 of the female connector 1**, and the fitting abutment surfaces of the two connectors are not completely abutted against each other, thus inviting a problem that the two connectors can not be fitted together at a predetermined fitting depth.

In the type of construction in which a relatively large tapered surface 41 for guiding the front holder 31 is formed on the inner surface of the peripheral wall 25 as shown in FIG. 8, when the front holder 31 is pressed by the male terminal 5, the front holder 31 is tilted through the tapered surface 41 as in the above case, or is projected generally uniformly from the front end surface **25*a* of the peripheral wall 25**, thus inviting the same problem as described above.

SUMMARY OF THE INVENTION

The present invention has been made in view of the above problems, and an object of the invention is to provide a connector construction in which even if a front holder, having guide surfaces for respectively guiding mating terminals, is pressed and tilted by the mating terminal, the front holder will not be projected outwardly beyond a front end surface of a housing, thus ensuring a properly-fitted condition of the connector, thereby enhancing the connector fitting reliability.

The above object has been achieved by a connector construction of the invention wherein a front end surface of a connector housing serves as a fitting abutment surface for abutment against a mating connector; a recessed portion is formed in the fitting abutment surface; a front holder for detecting a half-fitted condition of a terminal and for effecting the double retaining of the terminals is attached to the recessed portion; and tapered portions, which respectively guide mating terminals when the two connectors are to be fitted together, are formed at the front holder, wherein the front holder is fitted in the recessed portion in such a manner that a front surface of the front holder is disposed inwardly of the fitting abutment surface of the connector housing.

Even if the mating terminal abuts against the tapered portion of the front holder, so that the front surface of the front holder is tilted, the front holder will not project outwardly beyond the fitting abutment surface of the connector housing, and when the two connectors are fitted together, the fitting abutment surfaces of the female and male connectors are always abutted against each other.

DETAILED DESCRIPTION OF THE PREFERRED EMBODIMENTS

A preferred embodiment of a connector construction of the present invention will now be described in detail with reference to the drawings.

Figure 1:
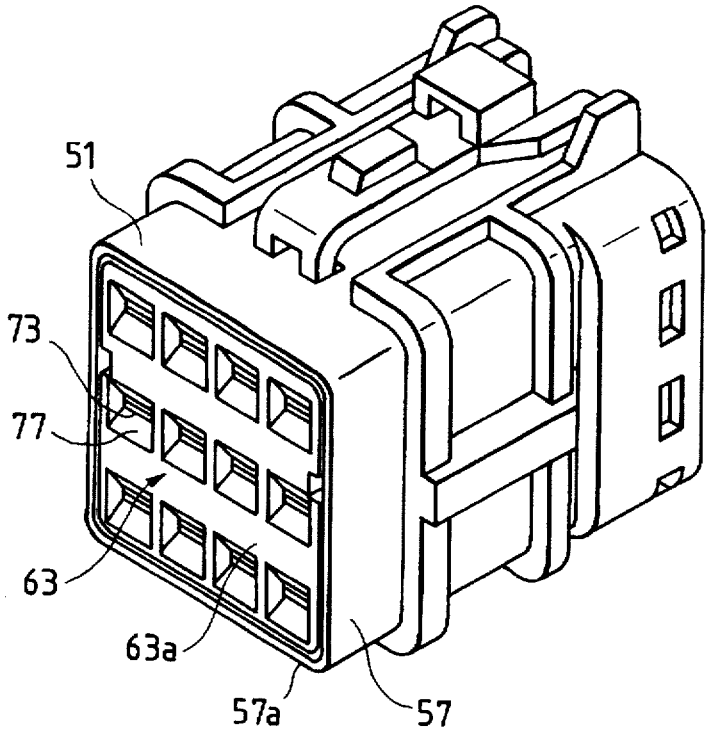
FIG. 1 is a perspective view of a male connector having a connector construction of the invention.
Figure 2:
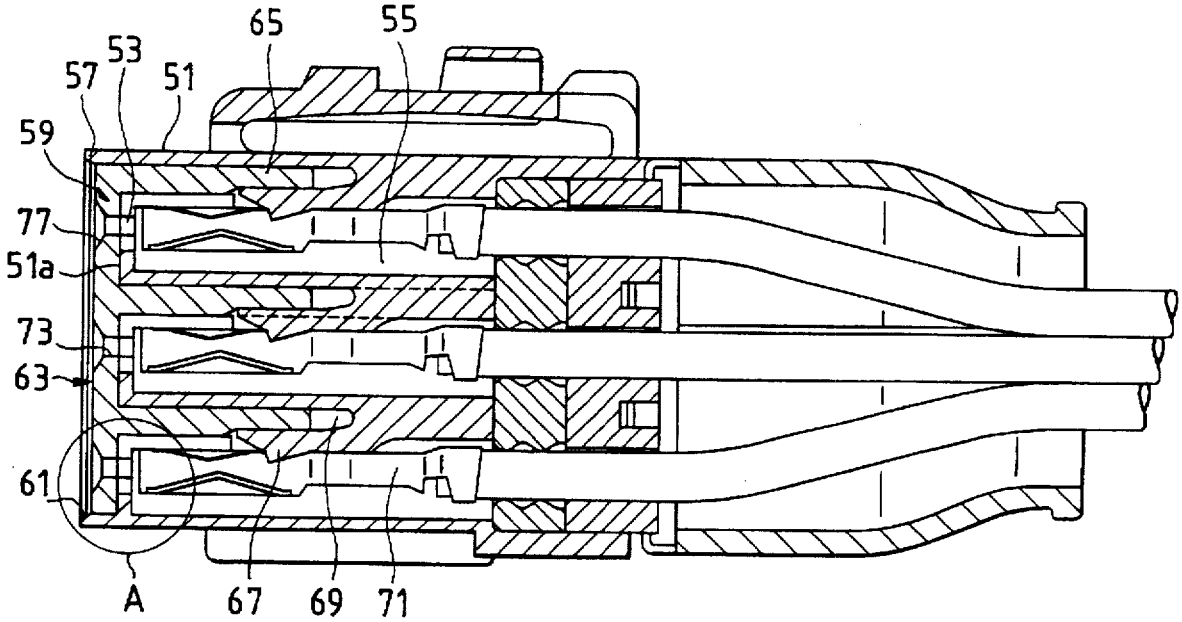
FIG. 2 is a cross-sectional view of the male connector having the connector construction of the invention.
Figure 3:
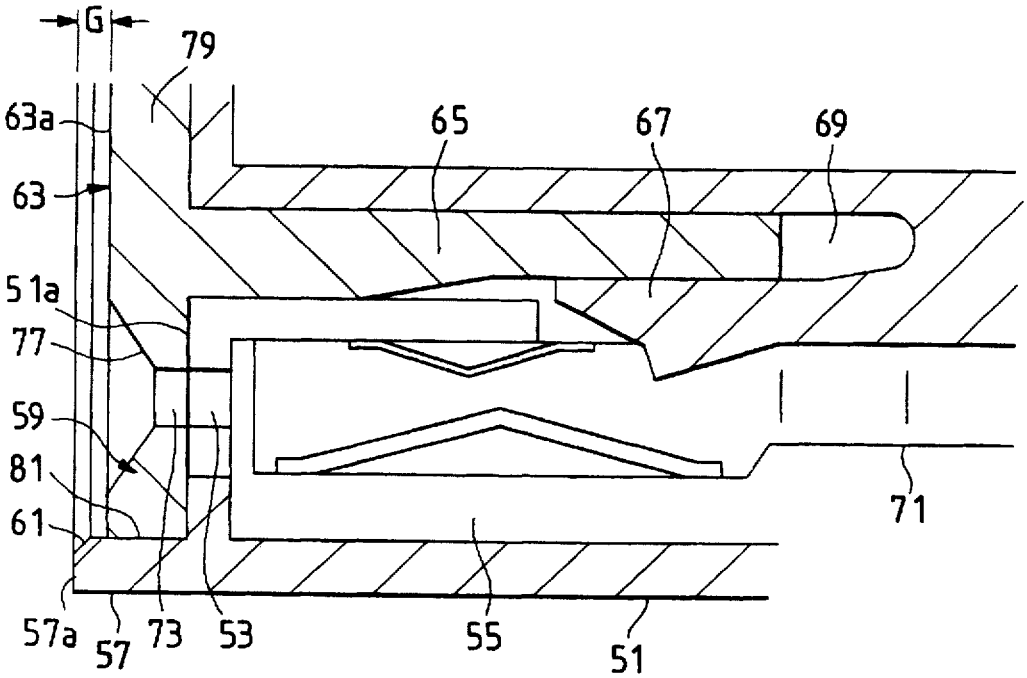
FIG. 3 is an enlarged view of a portion A of FIG. 2.
Figure 4:
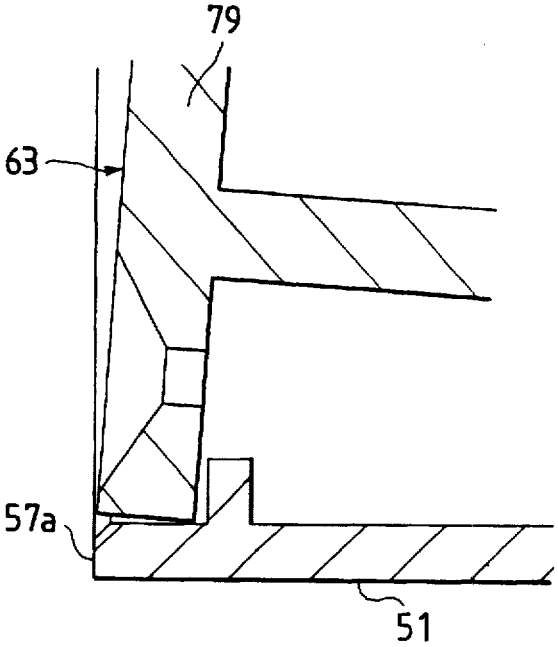
FIG. 4 is a view showing a front holder attached in a tilted manner.
Figure 5:
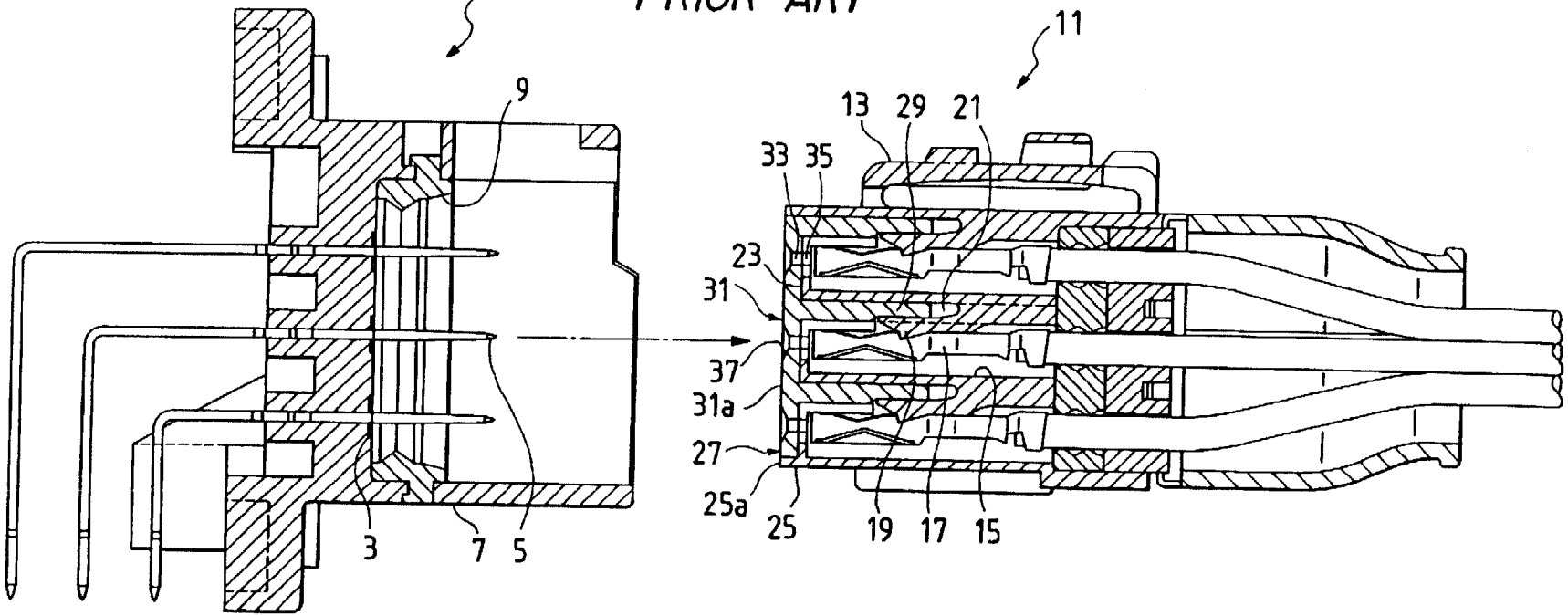
FIG. 5 PRIOR ART
FIG. 5 is a cross-sectional view showing a conventional connector to which a front holder is attached.
Figure 6:
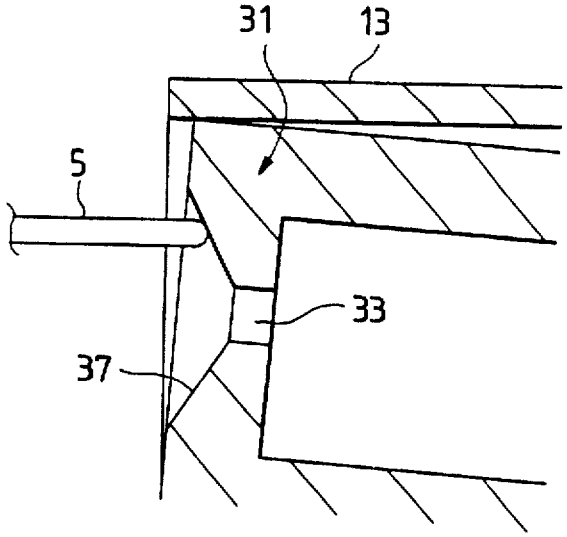
FIG. 6 PRIOR ART
FIG. 6 is a view showing a male terminal abutted against a tapered portion in an inclined manner.
Figure 7:
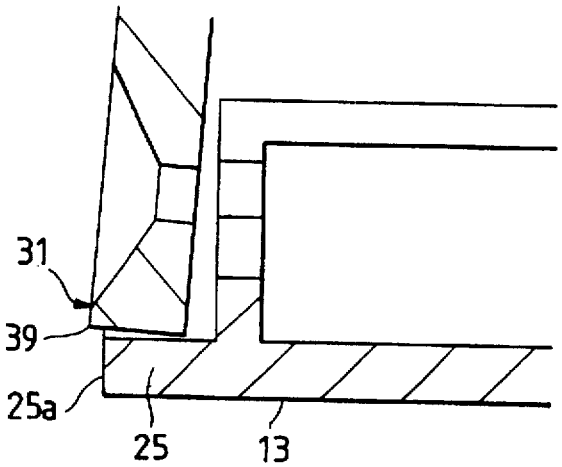
FIG. 7 PRIOR ART
FIG. 7 is a view showing the front holder projected from a front end surface of a housing.

FIG. 1 is a perspective view of a male connector having the connector construction of the invention. FIG. 2 is a cross-sectional view of the male connector having the connector construction of the invention. FIG. 3 is an enlarged view of a portion A of FIG. 2, and FIG. 4 is a view showing a front holder attached in a tilted manner.

The connector construction of the invention is applied to the type of connector to which a front holder, having tapered portions (guide surfaces) for respectively guiding mating male terminals, is attached. Therefore, this construction can be applied to ordinary male connectors except special connectors. In this embodiment, this construction is applied to the male connector, and this will now be described.

Terminal insertion ports 53 for respectively passing male terminals 5 therethrough are formed in a front surface 51*a* of a connector housing 51, and these terminal insertion ports 53 communicate respectively with terminal receiving chambers 55 formed in the connector housing 51. A peripheral wall 57 extends from a peripheral edge portion of the front surface 51*a*, and the front surface 51*a* forms a bottom of a recessed portion 59 surrounded by the peripheral wall 57. A tapered surface 61 is formed on an inner surface of the peripheral wall 57 at a front end thereof, and serves as a guide surface for guiding the front holder (described later).

The front holder 63 is attached to the recessed portion 59 surrounded by the peripheral wall 57, and the front holder 63 has insertion levers 65 projecting therefrom. The insertion levers 65 are inserted respectively into retraction spaces 69 formed respectively at back sides of elastic retaining piece portions 67 projecting respectively into the terminal receiving chambers 55, and prevent a half-fitted condition of female terminals 71 and the flexing of the elastic retaining piece portions 67, and effect the double retaining of the female terminals 71. Terminal insertion ports 73 are formed in a front surface of the front holder 63, and communicate respectively with the terminal insertion ports 53 in the connector housing 51. Tapered portions 77 are formed in the front surface of the front holder 63, and communicate respectively with the terminal insertion ports 73, the tapered portion 77 serving as a guide surface for guiding the male terminal 5 when fitting the connectors together.

In this embodiment, in order that the front holder 63 can be easily attached to the connector housing 51, the front holder 63 is fitted in the connector housing 51 with a predetermined clearance provided therebetween.

As shown in FIG. 3, the front holder 63 comprises a front plate 79, having the terminal insertion holes 73 and the tapered portions 77, and the insertion levers 65 extending from this front plate 79. When the front holder 63 is attached to the connector housing, with the insertion levers 65 inserted respectively in the retraction spaces 69, the front plate 79 is fitted in the recessed portion 59 surrounded by the peripheral wall 57. The thickness of the front plate 79 is smaller than the depth of the recessed portion 59, that is, the height of projecting of the peripheral wall 57. Namely, the front plate 79 is fitted in the recessed portion 59 in such a manner that the front plate 79 is disposed inwardly of a front end surface (fitting abutment surface of the connector housing) 57*a* of the peripheral wall 57. Namely, a gap G is formed between the fitting abutment surface 57*a* and the front surface 63*a* of the front holder 63. This gap G has such a dimension that even if the front holder 63 is attached to the connector housing in a tilted manner because of the presence of the above clearance, the outwardly-disposed end portion of the front holder 63 will not project outwardly beyond the fitting abutment surface 57*a*.

In this connector construction, even if the male terminal 5 abuts against the tapered portion 77 of the front holder 63, so that the front plate 79 of the front holder 63 is tilted as shown in FIG. 4, the front holder 63 will not project outwardly beyond the fitting abutment surface 57*a* of the connector housing 51. Therefore, when the two connectors are fitted together, the fitting abutment surfaces of the male and female connectors are always abutted against each other, so that the two connectors are fitted together at a predetermined fitting depth regardless of the inclination of the front holder 63 due to the clearance and other factor.

In the above connector construction, the front surface of the front holder 63 is disposed inwardly of the fitting abutment surface 57*a* of the connector housing 51, and therefore even if the front holder 63 is tilted, the front holder will not project outwardly beyond the fitting abutment surface 57*a*, and in any case the two fitting abutment surfaces can be abutted against each other, and therefore the two connectors can be fitted together at the predetermined fitting depth.

In the above embodiment, although the connector construction of the invention is applied to the male connector, the connector construction of the invention can be applied to any type of connector in which a front holder is attached to a fitting abutment surface of one connector, and the front holder has insertion guide surfaces for respectively guiding terminals of the other connector.

Figure 8:
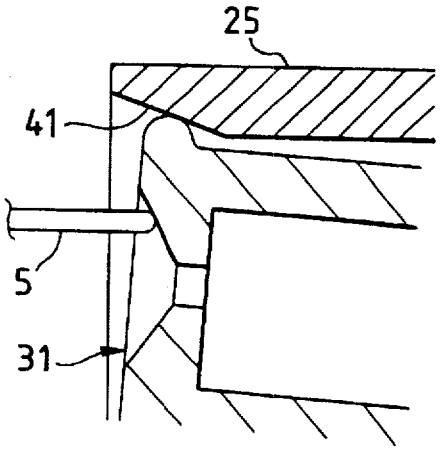
FIG. 8 PRIOR ART
FIG. 8 is a view showing a connector having a relatively large tapered surface (which guides the front holder) formed on an inner peripheral wall.

In the case where the connector construction of the invention is applied to the type of connector (as shown in FIG. 8) in which the relatively large tapered surface 41 is formed on the inner surface of the peripheral wall 25, it is preferred that the front holder should be fitted into such a depth that the front plate 79 can be disposed on a non-tapered, inner peripheral surface 81 (see FIG. 3) disposed rearwardly of the tapered surface 41.

As described above in detail, in the connector construction of the invention, the front surface of the front holder is disposed inwardly of the fitting abutment surface of the connector housing, and therefore even if the front holder is pressed and tilted by the mating terminal because of the presence of the clearance, the front holder will not project outwardly beyond the fitting abutment surface, and therefore the male and female connectors can always be fitted together, with their fitting abutment surfaces abutted against each other. As a result, the male and female connectors can always be fitted together at the predetermined depth, thereby enhancing the connector fitting reliability.

What is claimed is:

1. A connector comprising; a connector housing having a front end surface serving as a fitting abutment surface for abutment against a mating connector retaining a mating terminal; a recessed portion formed in said fitting abutment surface having a surface perpendicular to said fitting abutment surface and a first tapered surface;

a front holder for detecting a half-fitted condition of a terminal and for effecting the double retaining of said terminal, said front holder being attached to said recessed portion, said front holder being fitted in said recessed portion in such a manner that a front surface of said front holder is first in encountering said front holder to receive said mating terminal during abutment of said connector against said mating connector, said front surface containing both a second tapered surface and a non-tapered surface wherein said non-tapered surface is not flush with said fitting abutment surface wherein said front surface is disposed inwardly of said fitting abutment surface, said first tapered surface and at least a portion of said perpendicular surface;

said second tapered surface guiding said mating terminal when said connector and said mating connector are to be fitted together.

2. A connector as claimed in claim 1, wherein said recessed portion includes said first tapered surface at an inner peripheral portion of said recessed portion, said first tapered surface serves as a guide surface for guiding said front holder when said front holder is to be fitted in said recessed portion.

3. A connector as claimed in claim 1, wherein said front holder is fitted in said recessed portion in such a manner that the front surface of said front holder is disposed inwardly of said first tapered surface, located at an inner peripheral portion of said recessed portion, serving as the guide surface for said front holder.

* * * * *